US006088891A

United States Patent [19]

Cohrt et al.

[11] Patent Number: 6,088,891

[45] Date of Patent: Jul. 18, 2000

[54] DEVICE FOR CRIMPING SYNTHETIC THREAD BUNDLES OR STRIPS

[75] Inventors: Andreas Cohrt, Schleswig; Stephan Rickerts; Carsten Voigtlaeder, both of Neumuenster, all of Germany

[73] Assignee: Neumag - Neumuenstersche Maschinen - und Anlagenbau GmbH, Neumuenster, Germany

[21] Appl. No.: 09/284,885

[22] PCT Filed: Aug. 27, 1997

[86] PCT No.: PCT/EP97/04663

§ 371 Date: Jun. 21, 1999

§ 102(e) Date: Jun. 21, 1999

[87] PCT Pub. No.: WO98/18986

PCT Pub. Date: May 7, 1998

[30] Foreign Application Priority Data

Oct. 25, 1996 [DE] Germany ..... 296 18 671 U

[51] Int. Cl.[7] ..... D02G 1/12

[52] U.S. Cl. ..... 28/269; 28/267

[58] Field of Search ..... 28/256, 255, 254, 28/262, 269, 264, 263, 268, 270, 267

[56] References Cited

U.S. PATENT DOCUMENTS

| | | | |
|---|---|---|---|
| 3,283,387 | 11/1966 | Rosenstein | 28/269 |
| 3,363,041 | 1/1968 | Shichman et al. | 28/281 |
| 3,367,005 | 2/1968 | Clarkson | 28/256 |
| 3,372,446 | 3/1968 | Shichman et al. | 28/256 |
| 3,387,349 | 6/1968 | Trifunovic et al. | 28/269 |
| 3,600,776 | 8/1971 | Aoki et al. | 28/269 |
| 3,618,183 | 11/1971 | Funk et al. | 28/269 |
| 4,597,142 | 7/1986 | Bauch et al. | 28/269 |
| 5,778,502 | 7/1998 | Voigtlander et al. | 28/269 |

FOREIGN PATENT DOCUMENTS

| | | |
|---|---|---|
| 0 256 257 A2 | 2/1988 | European Pat. Off. . |
| 2 021 103 | 11/1970 | Germany . |
| 2 115 688 | 10/1971 | Germany . |
| 2 302 363 | 7/1974 | Germany . |
| 33 32 387 A1 | 3/1985 | Germany . |
| 35 03 447 A1 | 8/1985 | Germany . |
| 38 36 646 A1 | 5/1989 | Germany . |
| 487711 | 6/1938 | United Kingdom . |

*Primary Examiner*—Amy B Vanatta
*Attorney, Agent, or Firm*—Michael J. Striker

[57] ABSTRACT

A device for crimping synthetic thread bundles or strips has a machine frame, two rollers supported in a machine frame and forming between their jacket a narrow roller gap for delivering a thread bundle or strip, with the first roller provided on its face ends with edge disks which embrace the second roller with slight play and form there, between an annular channel, the edge disks having inside faces forming two opposed boundary faces, a compression chamber having a rectangular cross-section, enclosed by boundary faces, and located in the annular channel between the edge disks, an outer adapter contacting the second roller in scrapper like fashion, engaging the annular channel and having a wall face oriented toward the first roller and forming a third boundary face of the compression chamber, and drive mechanisms provided for the two rollers and having motors which are designed for a circumferential speed of the rollers of up to at least 1,000 m/min.

12 Claims, 5 Drawing Sheets

DEVICE FOR CRIMPING SYNTHETIC THREAD BUNDLES OR STRIPS

BACKGROUND OF THE INVENTION

The invention relates to a device for crimping synthetic thread bundles or strips.

A device that already has the characteristics of this preamble is known from British Patent 487 711. In this device, the two rollers that can be driven in contrary directions are disposed—as is usual in compression crimping devices—above one another. The upper roller is provided with edge disks. The compression chamber has a fixed bottom plate, which is disposed parallel to and a short distance from the plane of the roller gap, and a pivotable top plate. The opening of the orifice of the compression chamber is located at the level of the plane of the roller gap. The compression chamber extends approximately as far as the edge of the edge disks, whose diameter is approximately 1.5 times the roller diameter and cannot be selected substantially larger, for geometric reasons. The compression chamber is therefore comparatively small, compared with the diameter of the rollers.

German Patent Disclosure DE-OS 21 15 688 describes a device in which again one of the two rollers is provided with edge disks. In this device, the compression chamber is substantially larger, compared to the dimensions of the rollers. However, the inner faces of the edge disks form the lateral boundary faces only in a small region in the surroundings of the roller gap. By far the greater portion of the side faces is covered by fixed walls. There is necessarily a seam between the edge disks, which rotate with the rollers, and the fixed walls The same is true for another device, which is described in German Patent Disclosure DE-OS 20 21 103.

From German Patent Disclosure DE-OS 35 03 447, a device is known which is distinguished from the last two devices explained above in particular that the two rollers each have one edge disk, and the two edge disks are mounted on opposed face ends.

The subject of German Patent Disclosure DE-OS 38 36 646 is a compression crimping device, in which one roller is disposed in the interior of another roller, the latter embodied as an annular roller. There is a roller gap between the jacket face of the inner roller and the inside face of the annular roller.

One of the two rollers, which can be driven in the same direction, is provided with edge disks, which embrace the other roller. The edge disks, over the entire length of the compression chamber, form two opposed lateral boundary faces. Other boundary faces are formed by the inside face of the annular roller and by the jacket face of the inner roller. The compression chamber is therefore like the pointed end of a crescent, in side view. Because of the curved form, there is necessarily—in a deviation from all the other devices explained above—a spacing between the orifice opening and the plane of the roller gap. By the provision of a roller in the interior of an annular roller, the geometric conditions are made quite complicated and are greatly restricted. The compression chamber itself is therefore—compared with the dimensions of the overall device—rather small. Problems arise, particularly with respect to delivering the thread bundle to be compressed to the roller gap and drawing off the crimped material.

In many modern crimping devices, as can be learned from European Patent Disclosure EP 0 256 257 A2, for instance, a rotating pressure disk is let into a fixed side plate of the compression chamber and seals off the especially critical surroundings of the roller gap. Between the pressure disk and the side plate, there is intrinsically a seam. Compression chambers of this or similar design generally process yarn cables of very high titer of up to a few million dtex, at low speeds of up to about 300 or at the most 400 m/min.

The invention takes as its departure the problems presented particularly in crimping machines that run at substantially higher speeds. One such crimping machine is described for instance in German Patent Disclosure DE-OS 33 32 387. The compression chamber of rectangular cross section is enclosed by smooth boundary walls which are immovable in operation. Although speeds of 2000 m/min are mentioned in this reference, nevertheless in actual use this machine usually runs at speeds of up to about 1000 m/min and handles titers in the range of approximately 10,000 to 100,000 dtex. In operation, friction between the wall faces and the thread plug found in the compression chamber creates heat, so that at high speed the threads can even melt. There are accordingly limits to increasing the operating speed. At high speeds, increasing problems also arise from the fact that the thread catches at the gaps between the rotating roller and the stationary wall faces.

The inventors have recognized that the combination of characteristics recited in the preamble and known from British Patent 487711 offers the possibility, in high-speed crimping, of reducing the heating caused by friction considerably and reducing the danger that the threads will catch. Each face element of the inside faces of the edge disks is in contact with the thread plug for only a relatively brief period of time per revolution and thus is heated hardly at all. During the brief phase of contact, the relative speed between the plug and the inside faces of the edge disks is markedly lower than in compression chambers with fixed wall faces. The side wall faces are free of seams, so the thread is prevented from catching, at least in those regions.

SUMMARY OF THE INVENTION

Accordingly, in accordance with the present invention a device for crimping synthetic thread bundles or strips is proposed which is a further improvement of the existing devices.

In keeping with these objects and with others which will become apparent hereinafter, one feature of present invention resides, briefly stated in a device for crimping synthetic thread bundles or strips, which has a machine frame, two rollers supported in a machine frame and forming between their jacket a narrow roller gap for delivering a thread bundle or strip, the rollers including a first roller and a second roller arranged so that the first roller is provided on its face ends with edge disks which embrace the second roller with slight play and form there between an annular channel, the edge disks having inside faces which over an entire length of the compression chamber from the roller gap to the orifice and form two opposed boundary faces, a compression chamber to which the thread bundle or strip is delivered and which has an orifice, the compression chamber having a rectangular cross-section and being enclosed by first, second, third, and fourth boundary faces, the compression chamber being located in the annular channel between the edge disks, an outer adapter contacting the second roller in scrapper like fashion, the outer adaptor engaging the annular channel and having a wall face oriented toward the first roller and forming said third boundary face of the compression chamber, and drive mechanisms provided for the two rollers and having motors which are designed for a circumferential speed of the rollers of up to at least 1,000 m/min.

In accordance with another feature of the present invention, the orifice is spaced apart from the plane of the roller gap, specifically on the side on which the first roller is located, and also the third boundary face and the fourth boundary face opposite it are curved cylindrically over at least part of their length, while the axes of curvature are located on the same side of the plane of the roller gap as the first roller.

When the device is designed in accordance with these features, it makes it possible to increase the dimensions of the compression chamber markedly, compared with the diameter of the rollers.

DESCRIPTION OF PREFERRED EMBODIMENTS

Figure 1:
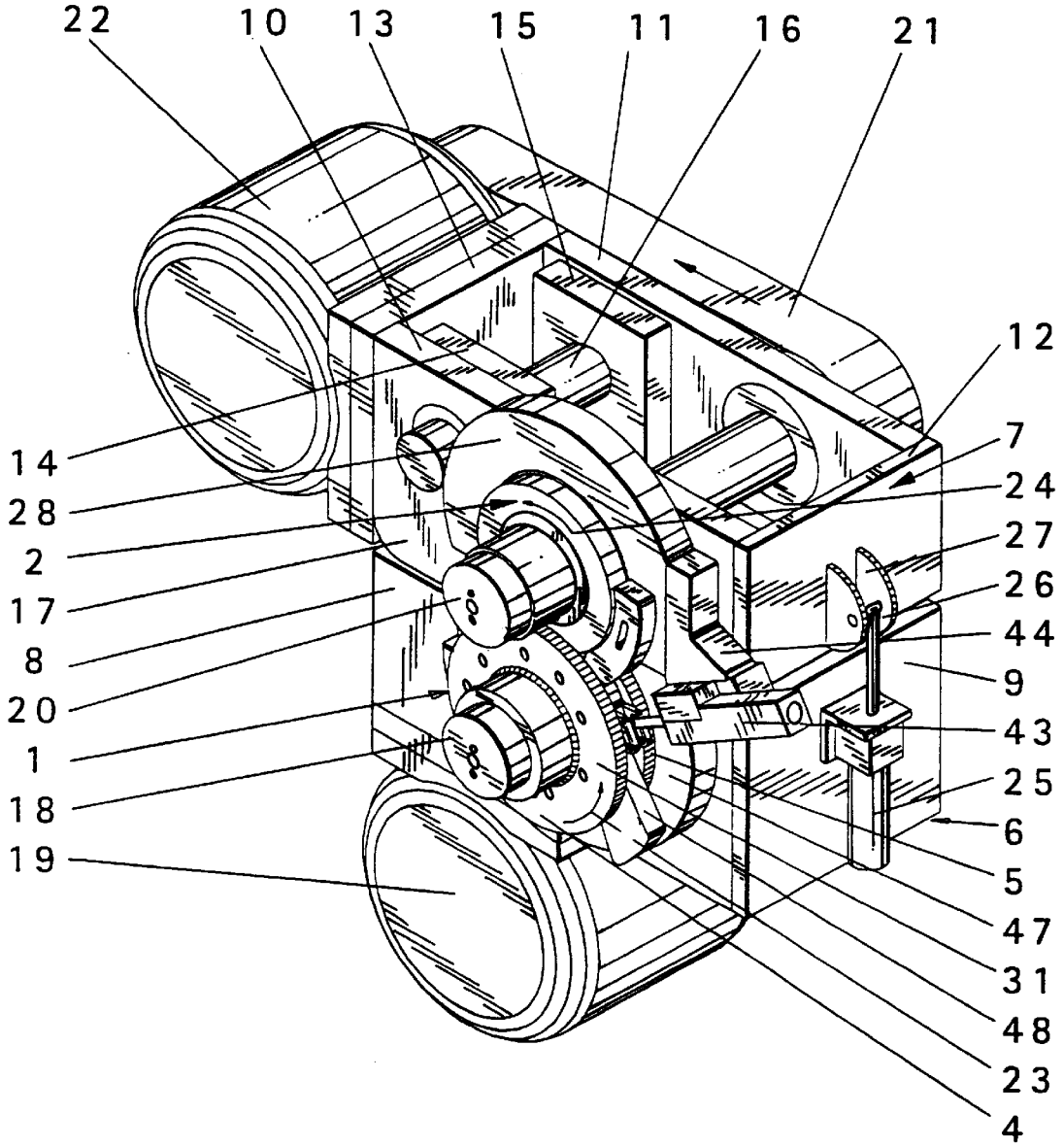
FIG. 1 shows an exemplary embodiment in a perspective view.

The device of the invention in general includes two rollers 1, 2, whose axes are parallel to one another and spaced apart such that a narrow roller gap 3 is located between the jacket faces of the two rollers 1, 2. The first roller 1 differs from the second roller 2 in that it is provided with edge disks 4, 5 on both of its end faces. These disks embrace the second roller 2, so that a slight play exists between the inside face of one edge disk 4, 5 and the end face, oriented toward it, of the second roller 2. The inside clearance between the two edge disks 4, 5 is 15 mm, for instance. As a rule, it is between 10 and 25 mm.

In all the drawing figures, the two rollers 1, 2 are disposed vertically one above the other, specifically in such a way that the first roller 1, having the edge disks 4, 5, is at the bottom. Although this arrangement, which is preferred in many cases, is not absolutely necessary and in practice may optionally be modified to suit conditions in an individual case, nevertheless for the sake of simplicity and clarity in this description the first roller 1, that is, the roller with the edge disks 4, 5, will always be called the "lower roller 1", and the other roller 2 will be called the "upper roller 2". Accordingly, the word "lower" in each case refers to the portion of the device of the invention in which the first roller 1 is located, while the term "upper" refers to the portion in which the second roller 2, which has no edge disks, is located.

FIG. 1 shows two rectangular frames 6, 7. The lower frame 6 is connected immovably to a load-bearing construction, not shown. It has a side wall 8 and an opposed side wall, not visible in the drawing, as well as an end wall 9 and an opposite end wall not visible in the drawing.

The upper frame 7 is constructed correspondingly and has side walls 10, 11 and end walls 12, 13. The arrangement of the two frames 6, 7 is reminiscent of two boxes stacked on one another.

One upward-pointing tab 14, 15 each is solidly connected to the side wall 8 of the fixed frame 6 and to the opposed side wall, which is concealed in the drawing. The tabs 14, 15 are provided with bores, in which a pivot shaft 16 is located. The ends of the pivot shaft 16 pass through the side walls 10, 11 of the upper frame 7 in the vicinity of the end wall 13, so that this frame is pivotable about the pivot shaft 16. To make the pivoting possible, the side walls 10, 7 have a curved rounded feature 17.

A shaft 18 is supported i the fixed frame 6, and its two ends protrude outward from the side walls. On the one end that passes through the side wall 8, the lower roller 1 is seated. The other end of the shaft 18 is coupled, via a gear not visible in the drawing, to a motor 19 disposed below the fixed frame 6.

A shaft 20 is supported in a corresponding way in the pivotable frame 7 between the pivot shaft 16 and the end wall 12. On the end that passes through the side wall 10, the upper roller 2 is seated. The upper end of the shaft 20 is coupled, via a toothed belt gear 21, with a motor 22 mounted on the end wall 13 adjacent to the pivot shaft 16.

The two motors 19, 22 are synchronized electronically, so that in operation the rollers 1, 2 rotate at the same circumferential speed but in opposite directions, as indicated by arrows 23, 24. In all the exemplary embodiments, the two rollers 1, 2 have the same diameter. Their rotary speeds therefore match. The motors 19, 20 are designed such that circumferential speeds of up to at least 1000 m/min are attainable. The preferred range begins at 2000 m/min and extends to above 3000 m/min.

A bidirectional cylinder 25 is secured to the end wall 9 of the fixed frame 6. The associated piston rod 26 engages an eyelet 27, which is connected to the end wall 12 of the pivotable frame 7. In operation, the piston and cylinder unit 25, 26 is switched in such a way that the upper roller 2 is loaded with a force acting in the direction of the lower roller 1. With this force, the upper roller 2 is pressed against the lower roller 1, or against the thread material located in the roller gap 3.

A disk 28 is seated between the upper roller 2 and the side wall 10, adjacent to it, of the pivotable frame 7; the disk is solidly connected to the side wall 10 and, particularly in the region remote from the pivot shaft 16, it protrudes past the circumference of the upper roller 2. An outer adapter 29 is secured to it. The adapter engages the annular channel, which is bounded by the jacket face 30 of the lower roller 1 and the inside faces of the edge disks 4, 5, which are secured for instance by screws 31 to the face ends of the lower roller 1 and have a diameter that is greater by 25 to 35% than the jacket face 30 of this roller.

Figure 2:
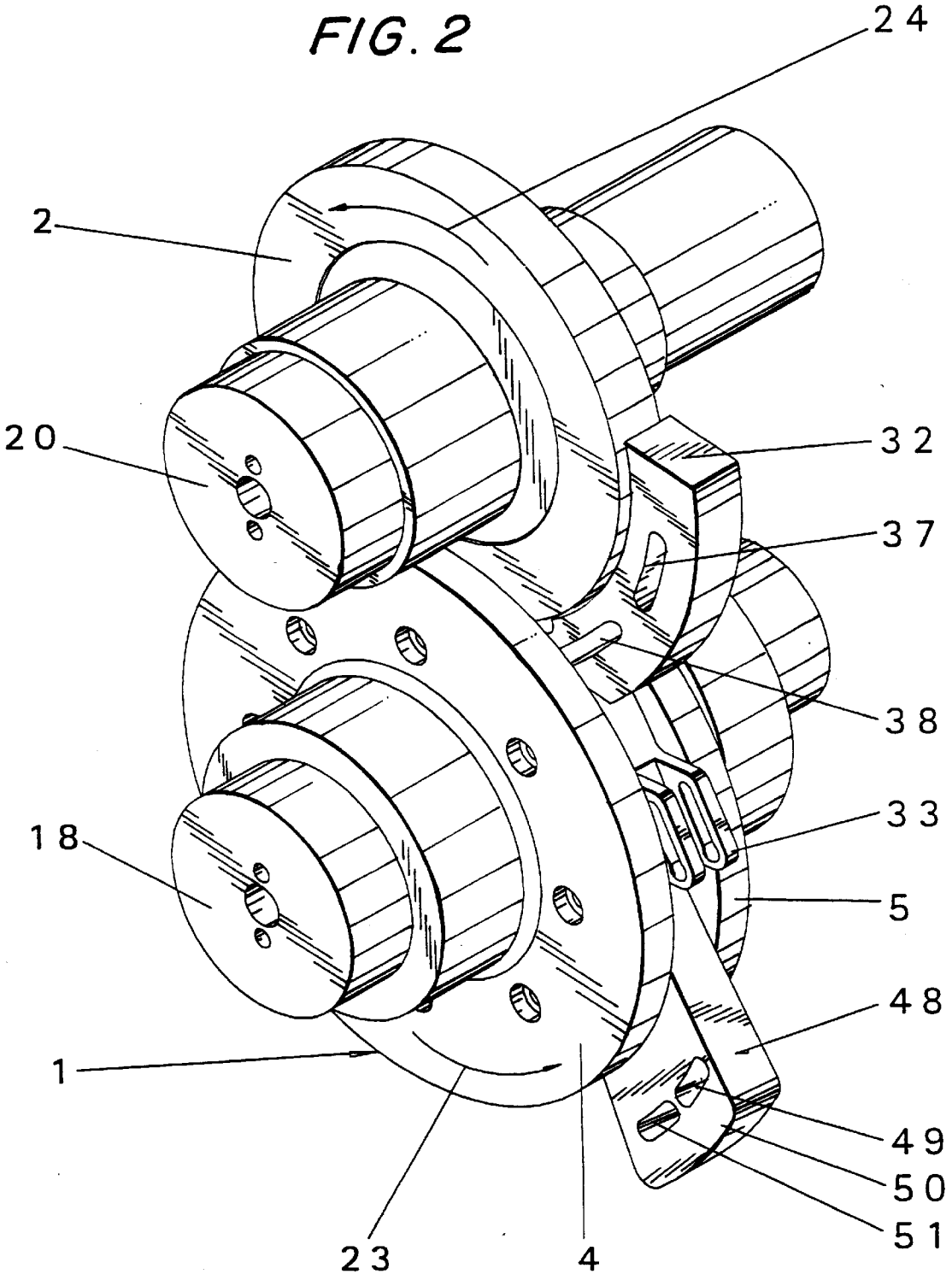
FIG. 2 shows core parts of the exemplary embodiment of FIG. 1, again in a perspective view.
Figure 3:
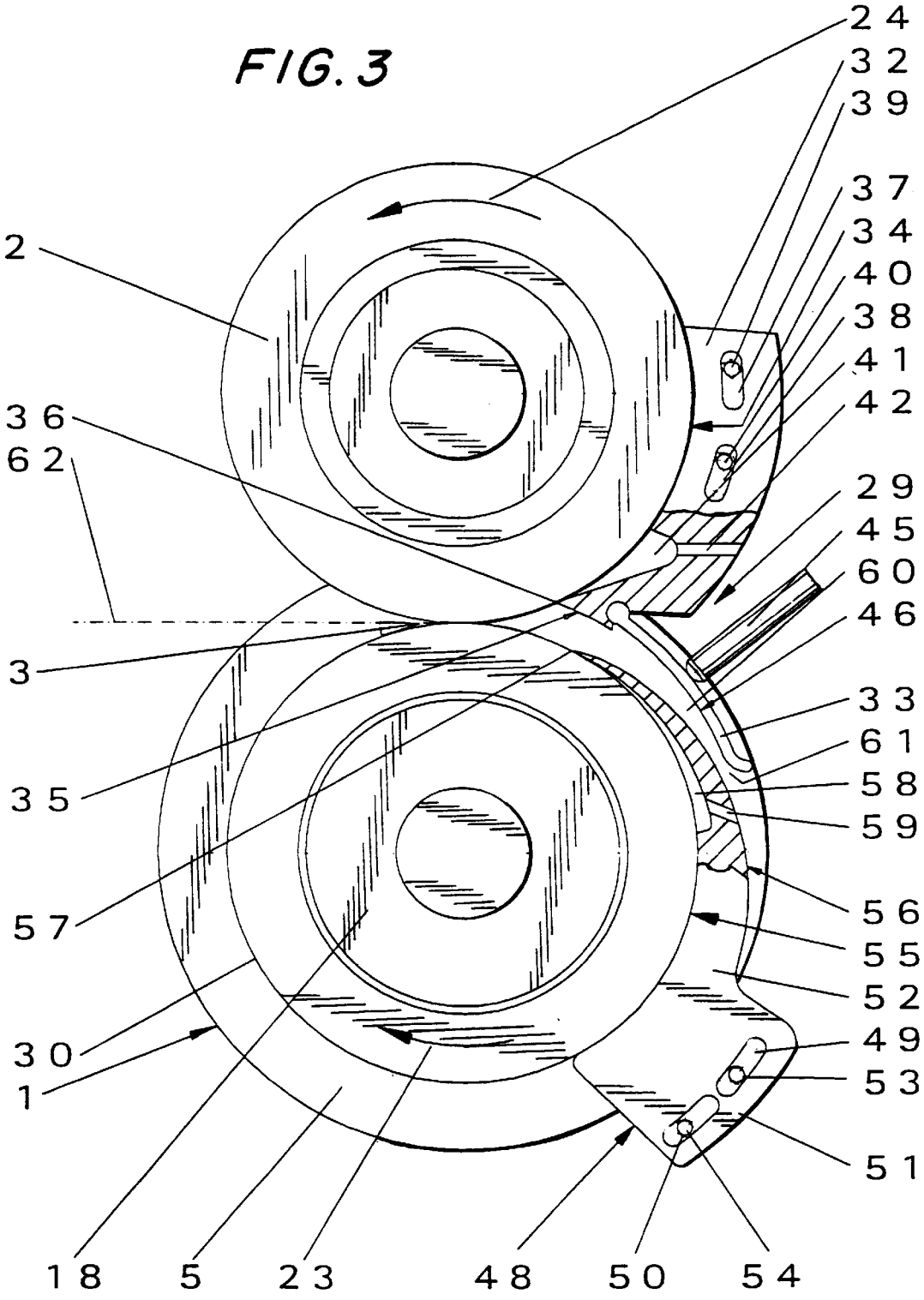
FIG. 3 shows the parts shown in FIG. 2, in a side view and partly in section.

The outer adapter 29, in the exemplary embodiment shown in FIGS. 1–3, comprises a base body 32 and a flap 33 pivotably connected to it. The base body 32 has a curved outer face 34, which conforms closely to the jacket face of the upper roller 2, and which with a lower wall face 35, oriented toward the lower roller 1, forms an acute-angled edge 36 in the vicinity of the roller gap 3 that is similar to the stripper edge of a scraper.

The base body 32 is provided with oblong slots 37, 38, which are disposed on a circular arc whose center point is located on the axis of the upper roller 2. The long sides of the oblong slots 37, 38 are correspondingly curved. Tangs 39, 40 which are joined on one end to the disk 28 and are threaded on the other, free end engage the oblong slots 37, 38. It thus becomes possible for the base body to be displaced in a limited angular range on the circular arc and the axis of the upper roller 2, and by means of screw nuts, not shown, that are seated on the tangs 39, 40, to lock the base body in any desired position within this angular range.

In the vicinity of the edge 36, on the side toward the upper roller 2, the base body 32 has recesses 41. The recesses can be connected, via bores 32 provided with female threads, to lines for delivering a medium that is under pressure. The delivery of compressed air in particular brings about cooling during operation and prevents threads from catching in the gap between the jacket face of the upper roller 2 and the edge 36.

The flap 33 can be loaded, by means of a pneumatic or hydraulic contact pressure device, with a force acting in the direction of the axis of the lower roller 1. A pressure cylinder 43 is secured to a retaining block 44, which is screwed to the disk 28. An associated piston rod 45, oriented approximately radially to the lower roller 1, engages the flap 3.

The wall face 46 of the flap 33 toward the lower roller 1 is curved cylindrically. The radius of curvature is at least equal to the radius of the jacket face 30 of the lower roller 1 and is preferably at most equal to the radius of the edge disks 4, 5. The axis of curvature is in the vicinity of the axis of the lower roller 1. Its exact location intrinsically depends on the position at the time of the base body 32 and the flap 33. Preferably the narrow boundary face 35 is also curved in a corresponding way.

A disk 47 is seated between the edge disk 5 and the side wall 8, adjacent to it, of the fixed frame 6 and is solidly joined to the side wall 8. At least in the region adjacent to the end wall 9, it protrudes past the circumference of the edge disk 5. In this region, an inner adapter 48 is secured to the disk 47. This adapter also engages the annular channel, which is defined by the jacket face 30 of the lower roller 1 and by the inside faces of the two edge disks 4, 5. The inner adapter 48 is embodied in one piece. It has a base 51, which is provided with oblong slots 49, 50, and an adjoining flange 52 of crescent-shaped cross section, which protrudes in the direction toward the roller gap 3 deeply into the hollow space located between the flap 33 and the jacket face of the lower roller 1. Tangs 53, 54 which are joined to the disk 47 protrude into the oblong slots 49, 50, so that—similarly to what has been described above for the base body 32—a displacement and locking in the region of a circular arc is possible, in this case naturally around the axis of the lower roller 1.

The inner adapter 48 has a curved inner wall face 55, which conforms closely to the jacket face 30 of the lower roller 1. A likewise cylindrically curved outer wall face 56 faces toward the flap 33. Its radius of curvature is greater than the radius of the jacket face 30 but less than the radius of the edge disks 4, 5. The axis of curvature is located in the vicinity of the axis of the lower wall 1. The inner wall face 55 and the outer wall face 56 form an edge 57 with a very acute angle, which—similarly to a stripper knife—rests on the jacket face 30 of the lower roller 1. It is located approximately perpendicular, or—depending on the point at which the base 51 is locked—laterally offset from the perpendicular below the edge 36 of the base body 32.

In the vicinity of the edge 57, the inner adapter 48 has recesses 58 on the side toward the lower roller 1. These recesses can be connected via bores 59 to lines for delivering pressurized medium. Between the lower wall face of the outer adapter 29, which face comprises the boundary face 35 and the curved wall face 46, on the one hand and the outer wall face 56 on the other, there is a curved compression chamber 60 of rectangular cross section, which in the position of the flap 33 shown in FIG. 3 becomes narrower toward its orifice 61. The orifice 61 is spaced apart from and below the plane 62 of the roller gap 3. The length of the compression chamber 60, that is, the distance from the roller gap 3 to the orifice 61, is markedly larger in FIG. 3 than the difference between the outer radius of the edge disk 4, 5 and the radius of the jacket face (30). Over the entire length, the compression chamber 60 is laterally bounded by the inside faces of the edge disks 4, 5.

Figure 4:
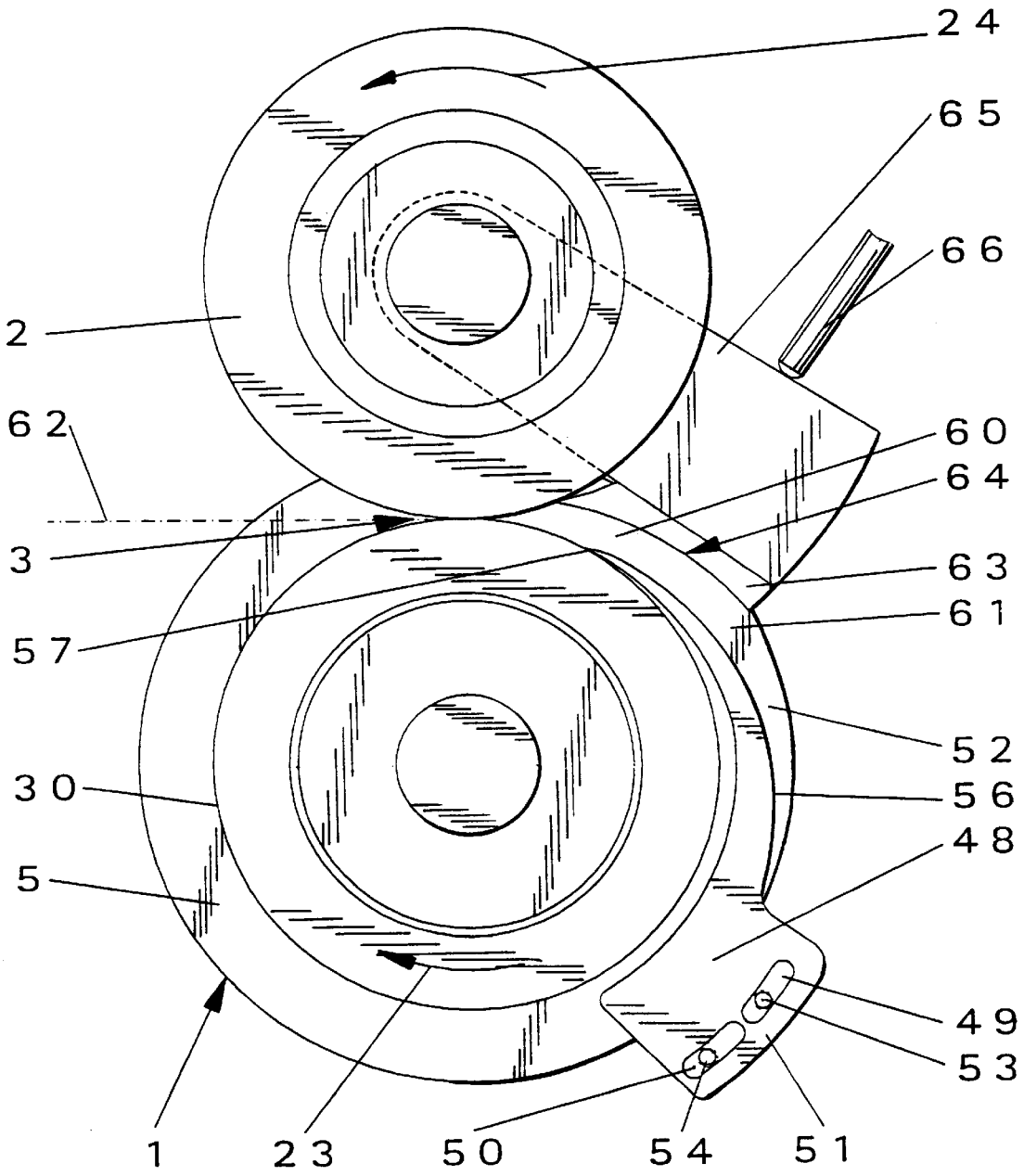
FIG. 4 shows another exemplary embodiment in a side view analogous to FIG. 3.

The exemplary embodiment shown in FIG. 4 differs from the exemplary embodiment described above in particular in the different shape and disposition of the outer adapter 63. It is embodied in one piece and has a cylindrically curved ball face 64 facing toward the lower roller 1. It is rigidly secured to a lever 65 which is pivotable about the axis of the upper roller 2. By means of a contact pressure device, of which FIG. 4 only in suggested fashion shows a hydraulically or pneumatically actuated piston rod 66, the outer adapter 63 can be loaded with a force aimed at the lower roller 1.

In this exemplary embodiment again, the inside faces of the edge disks 4, 5, over the entire length of the roller gap 3 up to the orifice 61, form two opposed boundary faces of the compression chamber 60. A third boundary face is formed by the curved wall face 64. The outer wall face 56 of the inner adapter 48—analogously to the exemplary embodiment described above—forms the fourth boundary face.

Figure 5:
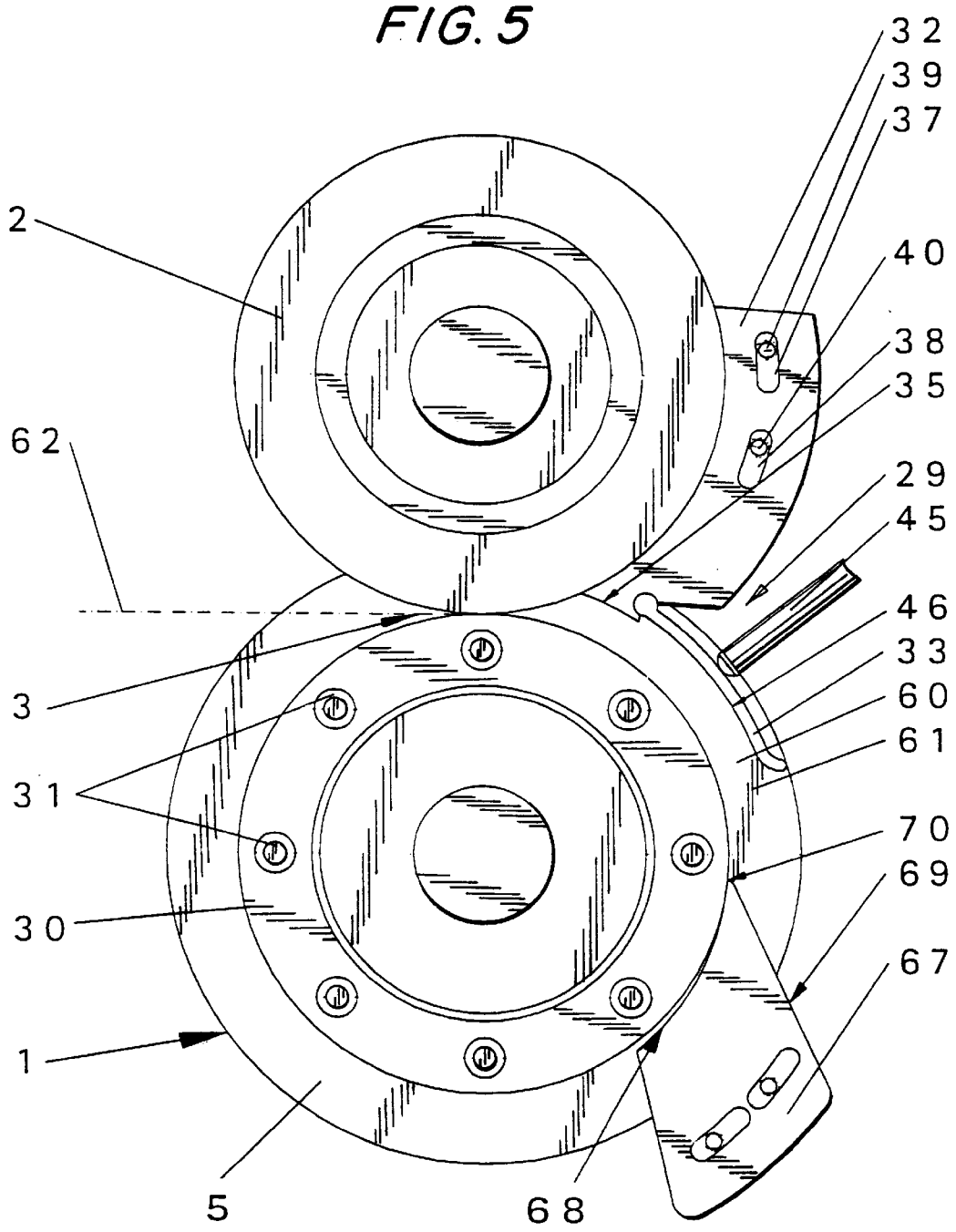
FIG. 5 shows a third exemplary embodiment, again in a side view analogous to FIG. 3.

The exemplary embodiment of FIG. 5 differs from the first exemplary embodiment described above in particular in that there is no inner adapter. The fourth wall face of the compression chamber 60, opposite the outer adapter 29, is formed here by the zone of the jacket face 30 located in this angular region at any given time.

A stripper 67 is seated in front of the orifice 61 of the compression chamber 60; it is displaceable and lockable—similarly to what has been described in conjunction with the inner adapter 48. It has a curved boundary face 68, which conforms to the jacket face 30 of the lower roller 1, and a flat slide face 69 for diverting the crimped material emerging from the orifice 61. The two faces 68, 69 form a stripper edge 70. The slide face 69 forms an angle of 30 to 40° with an imaginary tangential face that touches the jacket face 30 at the stripper edge 70. The size of the angle is uncritical over a side range. However, it should not be any greater than approximately 80°.

The device is suitable in particular for processing yarn cables in the range between 10,000 and 100,000 dtex.

What is claimed is:

1. A device for crimping synthetic thread bundles or strips, comprising a machine frame; two rollers supported in a machine frame and forming between their jacket a narrow roller gap for delivering a thread bundle or strip, said rollers including a first roller and a second roller arranged so that said first roller is provided on its face ends with edge disks which embrace said second roller with slight play and form therebetween an annular channel, said edge disks having inside faces which over an entire length of said compression chamber from said roller gap to said orifice form two opposed boundary faces; a compression chamber to which the thread bundle or strip is delivered and which has an orifice, said compression chamber having a rectangular cross-section and being enclosed by first, second, third, and fourth boundary faces, said compression chamber being located in said annular channel between said edge disks; an outer adapter contacting said second roller in scrapper like fashion, said outer adaptor engaging said annular channel and having a wall face oriented toward said first roller and forming said third boundary face of said compression chamber; and drive mechanisms provided for said two rollers and having motors which are designed for a circumferential speed of said rollers of up to at least 1,000 m/min.

2. A device as defined in claim 1, wherein said orifice is spaced apart from a plane of said roller gap on a side on which said first roller is located.

3. A device as defined in claim 1, wherein said third boundary face and said fourth boundary face opposite it are curved cylindrically over at least a part of their length so that axes of curvature of said third and fourth boundary faces are located at a same side of a plane of said roller gap as said first roller.

4. A device as defined in claim 1, wherein said outer adaptor has a base body adjacent to said second roller and a flap pivotably connected to said base body and extending as far as said orifice; and further comprising a contact pressure device which loads said flap with a force acting in a direction of said first roller.

5. A device as defined in claim 4, wherein said base body is displaceable over a circular arc about an axis of said second roller and is lockable in various angular positions.

6. A device as defined in claim 2, wherein said outer adaptor is formed of one piece and is pivotable about an axis of said second roller; and further comprising a contact pressure device which loads said outer adaptor by a force acting in a direction of said first roller.

7. A device as defined in claim 1, and further comprising an inner adaptor which contacts said first roller in scrapper like fashion and is seated between the jacket face of said first roller and said third boundary face, said inner adaptor having a wall face which is remote from said first roller and forms said fourth boundary face.

8. A device as defined in claim 7, wherein said inner adapter is displaceable over a circular arc about an axis of said first roller and is lockable in various angular positions.

9. A device as defined in claim 1, wherein a jacket face of said first roller forms said fourth boundary face; and further comprising a stripper secured to said machine frame upstream of said orifice and engaging said annular channel.

10. A device as defined in claim 1, wherein said outer adaptor has recesses for delivering a medium into a gap between its edge and a jacket face of said second roller.

11. A device as defined in claim 7, wherein said inner adaptor has recesses for delivering a medium into a gap between its edge and the jacket face of the second roller.

12. A device as defined in claim 9, wherein said stripper has recesses for delivering a medium into a gap between a stripper edge and a jacket face of the second roller.

* * * * *